US009126436B2

(12) United States Patent
Nagumo et al.

(10) Patent No.: US 9,126,436 B2
(45) Date of Patent: Sep. 8, 2015

(54) PRINTING MACHINE

(71) Applicant: RISO KAGAKU CORPORATION, Tokyo (JP)

(72) Inventors: Yasue Nagumo, Ibaraki (JP); Taiki Ichishita, Ibaraki (JP)

(73) Assignee: RISO KAGAKU CORPORATION, Tokyo (JP)

( * ) Notice: Subject to any disclaimer, the term of this patent is extended or adjusted under 35 U.S.C. 154(b) by 0 days.

(21) Appl. No.: 14/162,961

(22) Filed: Jan. 24, 2014

(65) Prior Publication Data

US 2014/0210153 A1 Jul. 31, 2014

(30) Foreign Application Priority Data

Jan. 25, 2013 (JP) ..... 2013-012163

(51) Int. Cl.

| | |
|---|---|
| ***B65H 5/02*** | (2006.01) |
| ***B41J 11/00*** | (2006.01) |
| ***B41J 13/00*** | (2006.01) |
| ***B65H 5/22*** | (2006.01) |
| ***B65H 7/02*** | (2006.01) |
| *B65H 29/24* | (2006.01) |

(52) U.S. Cl.

CPC ..... *B41J 11/0085* (2013.01); *B41J 13/0009* (2013.01); *B65H 5/224* (2013.01); *B65H 7/02* (2013.01); *B65H 29/242* (2013.01); *B65H 2301/44735* (2013.01); *B65H 2406/32* (2013.01); *B65H 2406/3222* (2013.01); *B65H 2513/50* (2013.01); *B65H 2515/212* (2013.01); *B65H 2515/342* (2013.01); *B65H 2515/81* (2013.01); *B65H 2701/1311* (2013.01); *B65H 2701/1313* (2013.01)

(58) Field of Classification Search

CPC ..... B65H 2406/36; B65H 2406/3622; B65H 2406/3632; B65H 29/242; B65H 2301/44735; B65H 2406/3221; B65H 2406/3222; B65H 2406/32

USPC ..... 271/265.04, 276

See application file for complete search history.

(56) References Cited

U.S. PATENT DOCUMENTS

| | | | | |
|---|---|---|---|---|
| 6,003,857 | A * | 12/1999 | Salomon et al. | 271/122 |
| 6,015,146 | A * | 1/2000 | Siegel | 271/98 |
| 2010/0213666 | A1 * | 8/2010 | Harney et al. | 271/276 |
| 2010/0244364 | A1 * | 9/2010 | Komiyama et al. | 271/12 |

FOREIGN PATENT DOCUMENTS

JP 2010-149310 A 7/2010

* cited by examiner

*Primary Examiner* — Howard Sanders

(74) *Attorney, Agent, or Firm* — Greenblum & Bernstein P.L.C.

(57) ABSTRACT

A printing machine includes: a paper feed unit configured to feed a sheet of paper; a suction transfer unit configured to transfer the sheet of paper fed by the paper feed unit in a transfer direction, with the sheet of paper being attached by suction onto a transfer surface; a transfer and paper discharge unit configured to receive the sheet of paper from the suction transfer unit to transfer and discharge the sheet of paper; and a controller configured to control a suction force of the suction transfer unit in accordance with a paper type. When the controller changes the suction force of the suction transfer unit between successive sheets of paper, the controller is configured prior to a discharge of a precedent sheet of paper to change the suction force of the suction transfer unit and drive the paper feed unit to feed a subsequent sheet of paper.

2 Claims, 8 Drawing Sheets

| PAPER TYPE | AIR FLOW RATE |
|---|---|
| ORDINARY PAPER | HIGH |
| THICK PAPER | HIGH |
| THIN PAPER | LOW |

FIG. 6

| | PRECEDENT SHEET | | SUBSEQUENT SHEET | | CHANGE OF AIR FLOW RATE | TIMING FOR CHANGING AIR FLOW RATE |
|---|---|---|---|---|---|---|
| | PAPER TYPE | PAPER SIZE | PAPER TYPE | PAPER SIZE | | |
| 1 | ORDINARY SHEET THICK SHEET | ANY SIZE | THIN SHEET | ANY SIZE | HIGH→LOW | WHEN AMOUNT OF TRANSFER REACHES REFERENCE VALUE AFTER LEADING EDGE OF PRECEDENT SHEET REACHES DOWNSTREAM END OF BELT TRANSFER UNIT |
| 2 | THIN SHEET | LARGE SIZE | ORDINARY SHEET THICK SHEET | ANY SIZE | LOW→HIGH | WHEN TRAILING EDGE OF PRECEDENT SHEET REACHES DOWNSTREAM END OF BELT TRANSFER UNIT |
| 3 | THIN SHEET | SMALL SIZE | ORDINARY SHEET THICK SHEET | ANY SIZE | LOW→HIGH | WHEN AMOUNT OF TRANSFER REACHES REFERENCE VALUE AFTER LEADING EDGE OF PRECEDENT SHEET REACHES DOWNSTREAM END OF BELT TRANSFER UNIT |

PRINTING MACHINE

CROSS REFERENCE TO RELATED APPLICATION

This application is based upon and claims the benefit of priority from the prior Japanese Patent Application No. 2013-012163, filed on Jan. 25, 2013, the entire contents of which are incorporated herein by reference.

BACKGROUND

1. Technical Field

The present invention relates to a printing machine configured to perform printing on paper.

2. Related Art

A printing machine which performs printing by ejecting ink from an inkjet head while transferring paper is described in Japanese Patent Application Publication No. 2010-149310. In order to perform printing while transferring paper, this printing machine transfers the paper as follows: the paper is attached onto a looped conveyor belt with multiple through holes by air suction using a fan, and the conveyor belt is endlessly moved.

Here, in the case where paper is attached onto a conveyor belt by air suction using a fan, the air flow rate of the fan is changed in accordance with the type of the paper in some cases. The higher the air flow rate of the fan, the stronger the suction force of the paper to the conveyor belt. For example, the air flow rate of the fan is set lower in transferring thin paper, than in transferring ordinary or thick paper. Such control of the air flow rate prevents the occurrence of wrinkles in thin paper during the transfer of the thin paper and the floating of ordinary or thick paper during the transfer of the ordinary or thick paper.

SUMMARY

In a printing machine described above, there are cases where plural types of sheets of paper are successively printed. For example, using a binding printing function, the printing machine successively prints sheets of paper for body pages and a sheet of paper for a cover page which are different types of sheets of paper. In such printing, the air flow rate of the fan may need to be changed between different types of successive sheets.

Heretofore, in such a case, after the discharging of a precedent sheet is finished, the air flow rate of the fan is changed, and then a subsequent sheet is fed. Accordingly, every time the air flow rate of the fan is changed, a printing operation is interrupted. Thus, productivity is decreased.

An object of the present invention is to provide a printing machine which can reduce a decrease in productivity.

A printing machine in accordance with some embodiments includes: a paper feed unit configured to feed a sheet of paper; a suction transfer unit configured to transfer the sheet of paper fed by the paper feed unit in a transfer direction, with the sheet of paper being attached by suction onto a transfer surface; a transfer and paper discharge unit configured to receive the sheet of paper from the suction transfer unit to transfer and discharge the sheet of paper; and a controller configured to control a suction force of the suction transfer unit in accordance with a paper type. When the controller changes the suction force of the suction transfer unit between successive sheets of paper, the controller is configured prior to a discharge of a precedent sheet of paper to change the suction force of the suction transfer unit and drive the paper feed unit to feed a subsequent sheet of paper.

According to the above-described configuration, in the case where the suction force of the suction transfer unit is changed between successive sheets of paper, the change of the suction force by the suction transfer unit and the feed of a subsequent sheet by the paper feed unit are performed before a precedent sheet is discharged. Accordingly, a decrease in productivity can be reduced.

When the controller changes the suction force of the suction transfer unit between the successive sheets of paper, the controller may be configured to change the suction force of the suction transfer unit at a time when a trailing edge of the precedent sheet of paper reaches a downstream end of the suction transfer unit in the transfer direction.

According to the above-described configuration, the suction force of the suction transfer unit is changed at the time when the trailing edge of the precedent sheet reaches the downstream end of the suction transfer unit with respect to the transfer direction. This makes it possible to further shorten the distance between the precedent sheet and the subsequent sheet and further reduce a decrease in productivity.

When the controller changes the suction force of the suction transfer unit between the successive sheets of paper, and when the precedent sheet of paper and the subsequent sheet of paper are in a prescribed combination in the paper type and a paper size, the controller may be configured to change the suction force of the suction transfer unit in a period after a leading edge of the precedent sheet of paper reaches the downstream end of the suction transfer unit in the transfer direction and before the trailing edge of the precedent sheet of paper reaches the downstream end of the suction transfer unit.

According to the above-described configuration, in the case where the precedent sheet and the subsequent sheet are in the prescribed combination in paper type and paper size, the suction force of the suction transfer unit is changed in a period after the leading edge of the precedent sheet reaches the downstream end of the suction transfer unit in the transfer direction and before the trailing edge of the precedent sheet reaches the downstream end of the suction transfer unit. This makes it possible to further reduce a decrease in productivity while reducing sheet deterioration.

BRIEF DESCRIPTION OF DRAWINGS

FIG. 6 is a view showing the relationship between paper type combinations of a precedent sheet and a subsequent sheet and timings of the change of the air flow rate of the fan according to a second embodiment.

DETAILED DESCRIPTION

Figure 1:
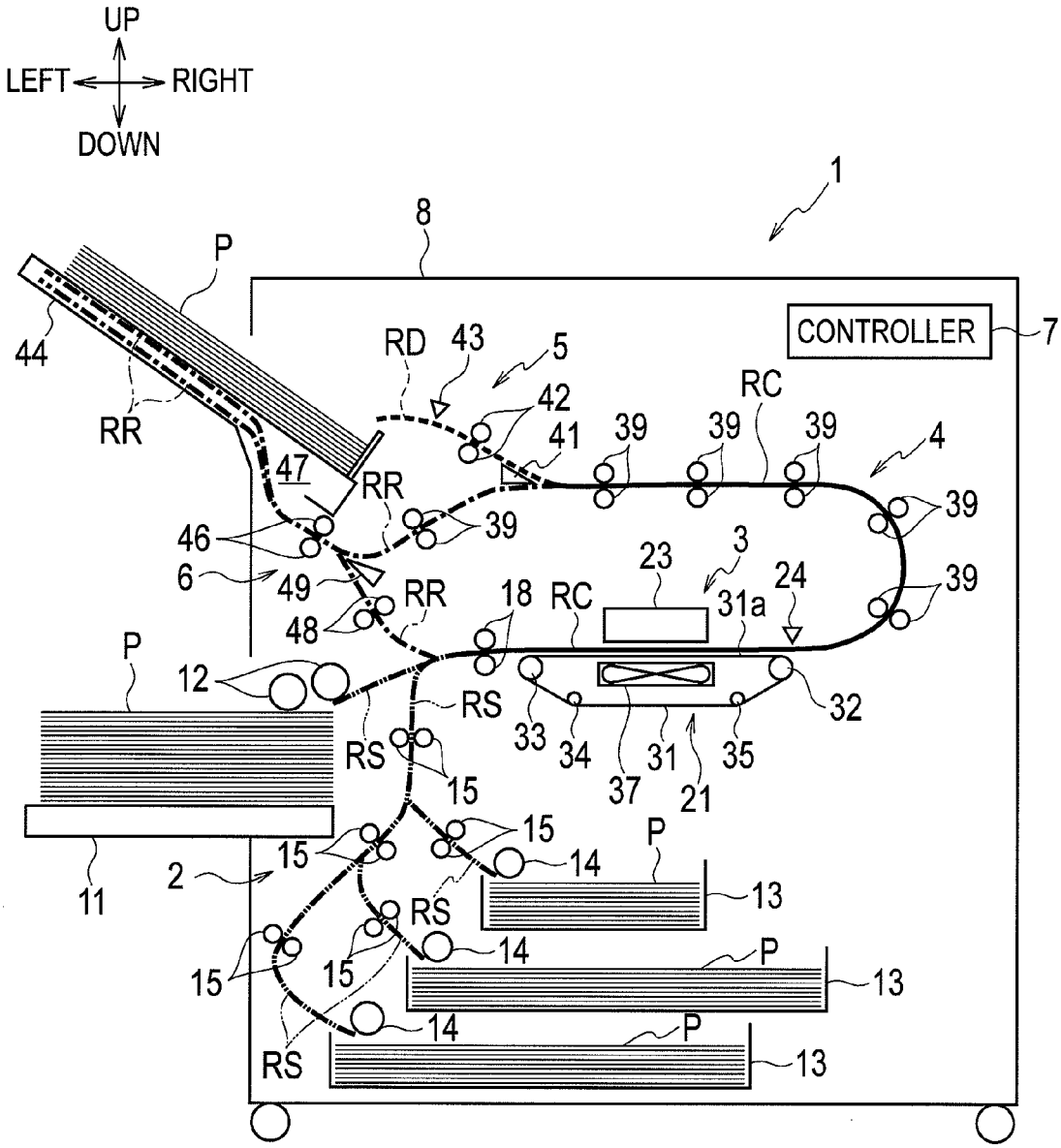
FIG. 1 is a schematic configuration diagram of a printing machine according to a first embodiment.

In the following detailed description, for purposes of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing.

Moreover, embodiments described below are intended to show examples of devices and the like for implementing technical principles of the invention, and the technical principles of the invention do not limit the arrangement of components and the like to ones described below. The technical principles of the invention can be variously modified within the scope of the appended claims.

First Embodiment

Figure 2:
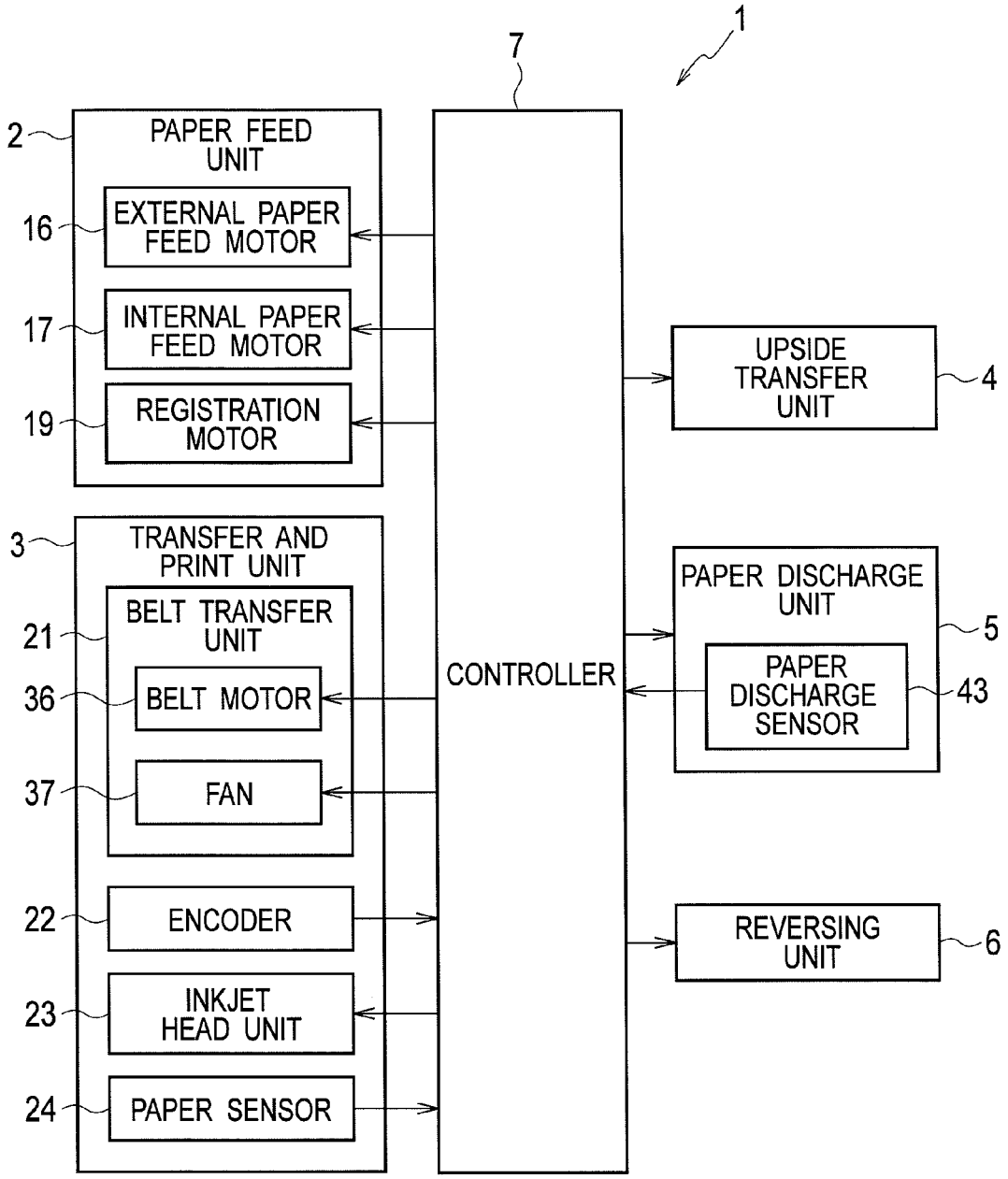
FIG. 2 is a control block diagram of the printing machine according to the first embodiment.

FIG. 1 is a schematic configuration diagram of a printing machine according to a first embodiment of the present invention, and FIG. 2 is a control block diagram of the printing machine shown in FIG. 1. In the description below, the direction of the front of the drawing of FIG. 1, in which a user is positioned, is defined as front. Moreover, as shown in FIG. 1, up, down, right, and left directions as seen by the user are defined as up, down, right and left directions.

In FIG. 1, routes represented by bold lines are transfer routes along which paper P as a print medium is transferred. Of the transfer routes, the route represented by a solid line is a common route RC, the route represented by a dashed dotted line is a reversing route RR, the route represented by a broken line is a paper discharge route RD, and the route represented by two-dot chain lines is a paper supply route RS. The words upstream and downstream in the description below mean upstream and downstream of a transfer route, respectively.

As shown in FIGS. 1 and 2, a printing machine 1 according to the first embodiment includes a paper feed unit 2, a transfer and print unit 3, an upside transfer unit 4, a paper discharge unit 5, a reversing unit 6, a controller 7, and a casing 8 for housing or holding each component.

The paper feed unit 2 feeds paper P. The paper feed unit 2 is arranged at the upstream end of the transfer routes. The paper feed unit 2 includes an external paper feed tray 11, external paper feed rollers 12, plural internal paper feed trays 13, plural internal paper feed rollers 14, plural pairs of vertical transfer rollers 15, an external paper feed motor 16, an internal paper feed motor 17, registration rollers 18, and a registration motor 19.

The external paper feed tray 11 is configured to hold a stack of paper P for printing. The external paper feed tray 11 is installed such that part thereof is exposed outside the casing 8.

The external paper feed rollers 12 pickup sheets of paper P one by one from the external paper feed tray 11 and transfer the paper P toward the registration rollers 18 along the paper supply route RS. The external paper feed rollers 12 are arranged above the external paper feed tray 11.

The internal paper feed trays 13 are configured to hold stacks of paper P for printing. The internal paper feed trays 13 are arranged inside the casing 8.

Each of the internal paper feed rollers 14 picks up sheets of paper P one by one from the internal paper feed trays 13 and send the paper P into the paper supply route RS. The internal paper feed rollers 14 are arranged above the internal paper feed trays 13, respectively.

The vertical transfer rollers 15 transfer the paper P picked up from the internal paper feed trays 13 toward the registration rollers 18. The vertical transfer rollers 15 are arranged along the paper supply route RS.

The external paper feed motor 16 rotationally drives the external paper feed rollers 12 and the most downstream vertical transfer rollers 15. The external paper feed motor 16 is connected to the external paper feed rollers 12 and the most downstream vertical transfer rollers 15 through unillustrated one-way clutches, respectively. Thus, when the external paper feed motor 16 rotates in one direction, the external paper feed rollers 12 are driven, and when the external paper feed motor 16 rotates in the other direction, the most downstream vertical transfer rollers 15 are driven.

The internal paper feed motor 17 rotationally drives the internal paper feed rollers 14 and other vertical transfer rollers 15 than the most downstream vertical transfer rollers 15. The internal paper feed motor 17 can be connected to and disconnected from the internal paper feed rollers 14 and the other vertical transfer rollers 15 through unillustrated clutches. With the clutches, the internal paper feed rollers 14 and the vertical transfer rollers 15 to be rotationally driven are switched.

The registration rollers 18 stops paper P transferred from the external paper feed rollers 12, the vertical transfer rollers 15, or undermentioned paper re-feed rollers 48 once, and then transfers the paper P toward the transfer and print unit 3. The registration rollers 18 are arranged in the vicinity of a junction of the paper supply route RS and the reversing route RR on the common route RC.

The registration motor 19 rotationally drives the registration rollers 18.

The transfer and print unit 3 prints an image on the fed paper P while transferring the paper P. The transfer and print unit 3 is arranged downstream of the paper feed unit 2. The transfer and print unit 3 includes a belt transfer unit (suction transfer unit) 21, an encoder 22, an inkjet head unit 23, and a paper sensor 24.

The belt transfer unit 21 transfers the paper P fed by the paper feed unit 2, with the paper P attached by suction onto a transfer surface 31*a*. The belt transfer unit 21 is arranged downstream of the registration rollers 18. The belt transfer unit 21 includes a conveyor belt 31, a driving roller 32, driven rollers 33, 34, and 35, a belt motor 36, and a fan 37.

The conveyor belt 31 is a looped belt passed over the driving roller 32 and the driven rollers 33 to 35. The conveyor belt 31 has multiple belt holes, which are through holes for holding by suction the paper P. The conveyor belt 31 holds by suction the paper P onto the transfer surface (upper surface) 31*a* by a suction force generated in belt holes by driving the fan 37. The conveyor belt 31 is rotated in a clockwise direction in FIG. 1 by driving the driving roller 32, thus transferring the paper P held by suction onto the transfer surface 31*a* to the right. The transfer surface 31*a* is the upper surface of the conveyor belt 31 which is an approximately horizontal surface between the driving roller 32 and the driven roller 35.

The driving roller 32 and the driven rollers 33 to 35 are components over which the conveyor belt 31 is passed. The driving roller 32 causes the conveyor belt 31 to rotate. The driven rollers 33 to 35 are driven by the driving roller 32 via the conveyor belt 31.

The driven roller 33 is arranged a prescribed distance away from the driving roller 32 to the left of the driving roller 32 at approximately the same height as the driving roller 32. The driven rollers 34 and 35 are arranged a prescribed distance away from each other in the right-left direction at approximately the same height below the driving roller 32 and the driven roller 33.

The belt motor 36 rotationally drives the driving roller 32.

The fan 37 produces a downward airflow. Thus, the fan 37 draws out air through the belt holes in the transfer surface 31*a* of the conveyor belt 31 to create negative pressures in the belt holes, thus attaching by suction the paper P onto the transfer surface 31*a*. The fan 37 is arranged in a space surrounded by the conveyor belt 31 passed over the driving roller 32 and the driven rollers 33 to 35.

The encoder 22 outputs a pulse signal every time the driven roller 33 rotates by a prescribed angle.

The inkjet head unit 23 includes a line-type inkjet head having plural nozzles arranged in a direction (front-back direction) approximately perpendicular to the direction of transfer of paper P. The inkjet head unit 23 is arranged above the belt transfer unit 21. The inkjet head unit 23 prints an image on paper P which is being transferred by the belt transfer unit 21, by ejecting ink from the inkjet head.

The paper sensor 24 detects the paper P which is being transferred, at a position corresponding to the downstream end of the belt transfer unit 21 in the transfer direction. The paper sensor 24 is made of an optical sensor including light-emitting elements and light-receiving elements.

The upside transfer unit 4 transfers paper P received from the belt transfer unit 21 to the right and then to the left such that the paper P makes a U turn. The upside transfer unit 4 corresponds to part of a transfer and paper discharge unit. The upside transfer unit 4 includes plural pairs of upside transfer rollers 39 and plural motors (not shown) configured to rotationally drive the plural pairs of upside transfer rollers 39.

The upside transfer rollers 39 transfers paper P while nipping the paper P. The most downstream pair of upside transfer rollers 39 are arranged upstream of the reversing route RR. The other upside transfer rollers 39 are arranged along the common route RC between the transfer and print unit 3 and the paper discharge unit 5.

The paper discharge unit 5 discharges printed paper P transferred from the upside transfer unit 4. The paper discharge unit 5 corresponds to part of the transfer and paper discharge unit. The paper discharge unit 5 includes a switching unit 41, paper discharge rollers 42, a paper discharge sensor 43, a paper receiving tray 44, a solenoid (not shown) configured to drive the switching unit 41, and a motor (not shown) configured to rotationally drive the paper discharge rollers 42.

The switching unit 41 switches the transfer route of paper P between the paper discharge route RD and the reversing route RR. The switching unit 41 is arranged at a point where the paper discharge route RD and the reversing route RR branch off.

The paper discharge rollers 42 transfer paper P guided to the paper discharge route RD by the switching unit 41 to discharge the paper P to the paper receiving tray 44. The paper discharge rollers 42 are arranged on the paper discharge route RD between the switching unit 41 and the paper receiving tray 44.

The paper discharge sensor 43 detects paper P to be discharged to the paper receiving tray 44. The paper discharge sensor 43 is arranged between the paper discharge rollers 42 and the paper receiving tray 44. The paper discharge sensor 43 is made of an optical sensor including light-emitting elements and light-receiving elements.

The paper receiving tray 44 is configured to hold a stack of discharged paper P. The paper receiving tray 44 is arranged at the downstream end of the paper discharge route RD.

The reversing unit 6, in double-sided printing, reverses paper P printed on one side thereof, and transfers the paper P to the registration rollers 18. The reversing unit 6 includes reversing rollers 46, a switchback unit 47, paper re-feed rollers 48, a switching gate 49, a motor (not shown) configured to rotationally drive the reversing rollers 46, and a motor (not shown) configured to rotationally drive the paper re-feed rollers 48.

The reversing rollers 46 temporarily carry paper P transferred from the upside transfer unit 4, into the switchback unit 47, and then move the paper P out to transfer the paper P to the paper re-feed rollers 48. The reversing rollers 46 are arranged on the reversing route RR between the most downstream pair of upside transfer rollers 39 and an entrance of the switchback unit 47.

The switchback unit 47 is a space into which the reversing rollers 46 temporarily carry paper P. The switchback unit 47 is formed in a lower portion of the paper receiving tray 44. The switchback unit 47 has an opening in the vicinity of the reversing rollers 46 so that paper P may be carried into the switchback unit 47.

The paper re-feed rollers 48 transfers paper P transferred from the reversing rollers 46, to the registration rollers 18. The paper re-feed rollers 48 are arranged on the reversing route RR between the reversing rollers 46 and the registration rollers 18.

The switching gate 49 guides paper P transferred from the upside transfer rollers 39, to the reversing rollers 46. Moreover, the switching gate 49 guides paper P to be moved out of the switchback unit 47 by the reversing rollers 46, to the paper re-feed rollers 48. The switching gate 49 is arranged in the vicinity of the centroid of three points corresponding to the most downstream pair of upside transfer rollers 39, the reversing rollers 46, and the paper re-feed rollers 48.

The controller 7 controls the operation of each unit of the printing machine 1. The controller 7 is configured to include a CPU, a RAM, a ROM, a hard disk drive, and the like.

The controller 7 controls the suction force of the belt transfer unit 21 in accordance with the type of paper in a printing operation. The controller 7 controls the suction force of the belt transfer unit 21 by controlling the air flow rate of the fan 37. The higher the air flow rate of the fan 37, the stronger the suction force of the belt transfer unit 21. In the case where the controller 7 changes the suction force of the belt transfer unit 21 between successive sheets of paper, the controller 7 performs control so that the change of the suction force of the belt transfer unit 21 and the feed of the subsequent sheet of paper by the paper feed unit 2 may be performed before the precedent sheet of paper P is discharged.

Next, the operation of the printing machine 1 will be described.

When the printing machine 1 starts a printing operation, unprinted paper P transferred from any one of the external paper feed tray 11 and the plural internal paper feed trays 13 of the paper feed unit 2 along the paper supply route RS is transferred to the transfer and print unit 3 by the registration rollers 18. In the transfer and print unit 3, the paper P is printed using ink ejected from the inkjet head unit 23 while being transferred by the belt transfer unit 21.

In the case of single-sided printing, paper P printed on one side thereof is transferred from the belt transfer unit 21 to the upside transfer unit 4 to be transferred by the upside transfer rollers 39 of the upside transfer unit 4, and is then guided to the paper discharge route RD by the switching unit 41. After that, the paper P is discharged to the paper receiving tray 44 by the paper discharge rollers 42.

In the case of double-sided printing, paper P printed on a front side thereof is transferred by the upside transfer rollers 39 of the upside transfer unit 4, and is then guided to the reversing route RR by the switching unit 41. In the reversing unit 6, the paper P guided to the reversing route RR is guided to the reversing rollers 46 by the switching gate 49 and carried into the switchback unit 47 by the reversing rollers 46. After that, the paper P is moved out of the switchback unit 47 by the reversing rollers 46 and guided to the paper re-feed rollers 48 by the switching gate 49. Further, the paper P is transferred to the registration rollers 18 by the paper re-feed rollers 48. Subsequently, the paper P is sent into the transfer and print unit 3 by the registration rollers 18. Here, since the paper P is reversed by the reversing unit 6, an unprinted side (back side) thereof is faced toward the inkjet head unit 23. In the transfer and print unit 3, the paper P is printed on a back side thereof using ink ejected from the inkjet head unit 23 while being transferred by the belt transfer unit 21. The paper P printed on both sides thereof is discharged to the paper receiving tray 44 as in the above-described single-sided printing. Here, the side of paper P which is printed first is referred to as a front side, and the side of paper P which is printed later is referred to as a back side.

In the case where plural sheets of paper are printed, the sheets of paper P are sequentially fed from the paper feed unit 2 to be printed and discharged.

Figures 3, 4:
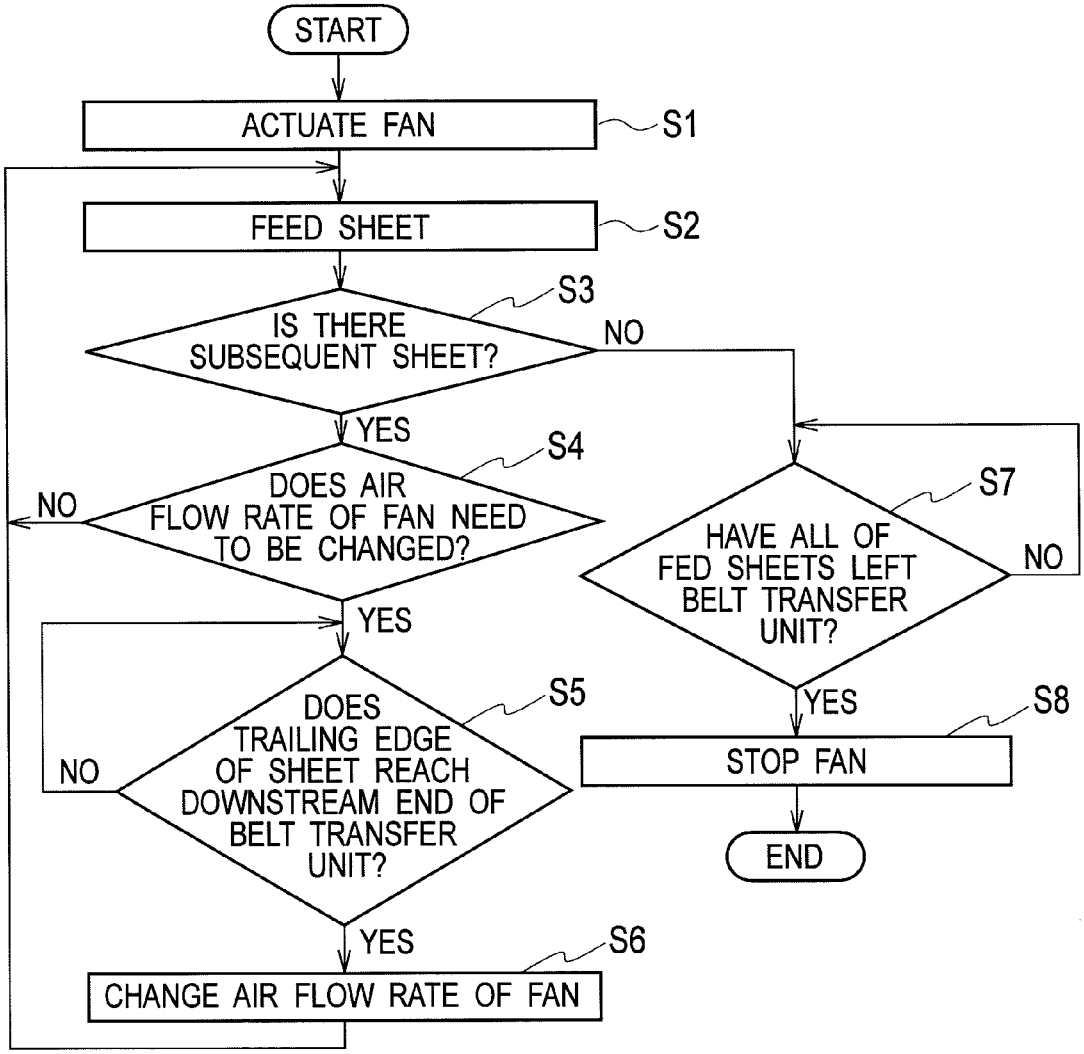
FIG. 3 is a view showing the relationship between paper types and set air flow rates of a fan.
FIG. 4 is a flowchart showing the control of the air flow rate of the fan according to the first embodiment.

In a printing operation, the controller 7 controls the suction force of the belt transfer unit 21 in accordance with the type of paper by controlling the air flow rate of the fan 37. FIG. 3 shows the relationship between paper types and set air flow rates of the fan 37. In the case of ordinary or thick paper (indicated by TK in FIGS. 5(*a*), 5(*b*), 8, and 9), the air flow rate is "high" to generate a suction force capable of preventing floating from the transfer surface 31*a*. In the case of thin paper (indicated by TN in FIGS. 5(*a*), 5(*b*), 8, and 9), floating from the transfer surface 31*a* is less prone to occur than in the case of ordinary or thick paper, but wrinkles may occur in the paper when the suction force is too strong. Accordingly, the air flow rate is "low."

In the printing machine 1, different types of sheets of paper which have different set air flow rates of the fan 37 may be successively fed and printed. For example, in the case where a print job in which thick paper and thin paper are used as print paper in a mixed manner is executed, there arises a situation in which thick paper and thin paper which have different set air flow rates of the fan 37 are successively fed and printed. An example of such a print job is a binding printing job in which thick paper and thin paper are used as paper for cover pages and paper for body pages, respectively. In such a case, the air flow rate of the fan 37 needs to be changed during a plural-sheet printing operation.

The control of the air flow rate of the fan 37 in a printing operation will be described with reference to a flowchart of FIG. 4. Here, the case of single-sided printing will be described.

A process shown in the flowchart of FIG. 4 is started by submitting a print job to the controller 7. When the print job is submitted, the controller 7 actuates the fan 37 in step S1 of FIG. 4. At this time, the controller 7 drives the fan 37 at the air flow rate corresponding to the paper type of a first sheet to be used in printing based on the print job.

Then, in step S2, the controller 7 controls the paper feed unit 2 so that the first sheet P may be fed from the registration rollers 18 to the transfer and print unit 3.

Subsequently, in step S3, the controller 7 determines based on the print job whether or not there is a subsequent sheet to be fed.

If the controller 7 determines that there is a subsequent sheet (step S3: YES), the controller 7 determines in step S4 based on the paper types of the most recently fed sheet P and the subsequent sheet P whether or not the air flow rate of the fan 37 needs to be changed for the subsequent sheet P from the current air flow rate.

If the controller 7 determines that the air flow rate of the fan 37 does not need to be changed (step S4: NO), the controller 7 causes the subsequent sheet P to be fed from the registration rollers 18 to the transfer and print unit 3 in step S2. At this time, the controller 7 controls the timing of paper feed so that the distance between the most recently fed sheet P and the subsequent sheet P may have a preset value.

If the controller 7 determines that the air flow rate of the fan 37 needs to be changed (step S4: YES), the controller 7 determines in step S5 whether or not the trailing edge (upstream edge) of the most recently fed sheet P reaches the downstream end of the belt transfer unit 21. Specifically, the controller 7 determines whether or not the paper sensor 24 detects the trailing edge of the most recently fed sheet P. It should be noted that the controller 7 may determine, based on the number of pulses outputted from the encoder 22 after the leading edge of the most recently fed sheet P reaches the upstream end of the belt transfer unit 21, whether or not the trailing edge of the most recently fed sheet P reaches the downstream end of the belt transfer unit 21.

If the controller 7 determines that the trailing edge of the most recently fed sheet P does reach the downstream end of the belt transfer unit 21 (step S5: NO), the controller 7 repeats step S5.

If the controller 7 determines that the trailing edge of the most recently fed sheet P reaches the downstream end of the belt transfer unit 21 (step S5: YES), the controller 7 changes the air flow rate of the fan 37 to the air flow rate corresponding to the subsequent sheet P in step S6. Then, the controller 7 causes the subsequent sheet P to be fed from the registration rollers 18 to the transfer and print unit 3 in step S2.

If the controller 7 determines in step S3 that there is no subsequent sheet P (step S3: NO), the controller 7 determines in step S7 whether or not all of fed sheets of paper P have left the belt transfer unit 21. Here, when the controller 7 determines that the trailing edge of the most recently fed sheet P reaches the downstream end of the belt transfer unit 21, the controller 7 determines that all of fed sheets of paper P have left the belt transfer unit 21. The determination as to whether or not the trailing edge of the most recently fed sheet P reaches the downstream end of the belt transfer unit 21 is made as in the aforementioned step S5.

If the controller 7 determines that one or more of the fed sheets of paper P have not left the belt transfer unit 21 (step S7: NO), the controller 7 repeats step S7.

If the controller 7 determines that all of the fed sheets of paper P have left the belt transfer unit 21 (step S7: YES), the controller 7 stops the fan 37 in step S8. Thus, the control of the air flow rate of the fan 37 is ended.

Figure 5:
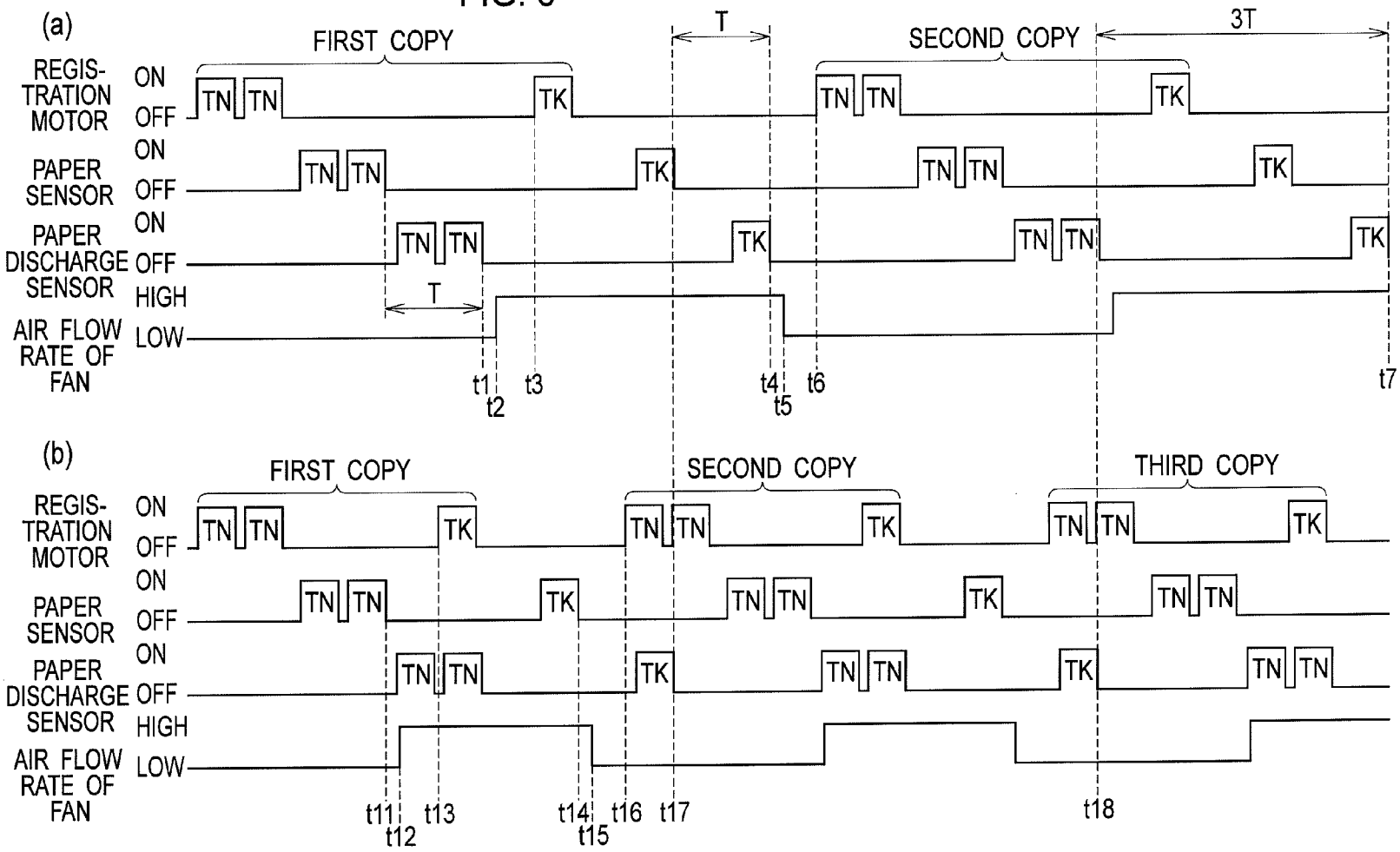
FIG. 5(*a*) is a timing diagram for the control of the air flow rate of the fan according to a comparative example, and FIG. 5(*b*) is a timing diagram for an example of the control of the air flow rate of the fan according to the first embodiment.

Next, an example of the control of the air flow rate according to the above-described process shown in the flowchart of FIG. 4 will be described with reference to timing diagrams of FIGS. 5(*a*) and 5(*b*). FIGS. 5(*a*) and 5(*b*) show the control of the air flow rate for the case where plural copies of a document including two thin sheets and one thick sheet are printed on one side of each sheet. Here, FIG. 5(*a*) shows the control of the air flow rate of a fan in a conventional printing machine as a comparative example, and FIG. 5(*b*) shows the control of the air flow rate according to the process shown in the flowchart of FIG. 4.

In each of FIGS. 5(*a*) and 5(*b*), a top row indicates the state, on/off, of the registration motor 19. After a sheet of paper P sent to the registration rollers 18 from the upstream side touches the registration rollers 18, the registration motor 19 is turned on to rotationally drive the registration rollers 18. Then, immediately after the registration rollers 18 sends the sheet of paper P into the belt transfer unit 21, the registration motor 19 is turned off. Thus, the registration motor 19 is driven briefly for each sheet.

In each of FIGS. 5(*a*) and 5(*b*), a second row from the top indicates the state, on/off, of the paper sensor 24. The paper sensor 24 remains turned on during a period in which a sheet of paper P is passing the downstream end of the belt transfer unit 21 as a detection position; otherwise, the paper sensor 24 remains turned off.

In each of FIGS. 5(*a*) and 5(*b*), a third row from the top indicates the state, on/off, of the paper discharge sensor 43. The paper discharge sensor 43 remains turned on during a period in which a sheet of paper P is passing a downstream end portion of the paper discharge route RD as a detection position; otherwise, the paper discharge sensor 43 remains turned off.

In each of FIGS. 5(*a*) and 5(*b*), a bottom row indicates whether the air flow rate of the fan 37 is "high" or "low."

In FIG. 5(*a*), after time t1 when the trailing edge of a thin second sheet for a first copy passes the paper discharge sensor 43, the air flow rate of the fan 37 is changed from "low" for thin paper to "high" for thick paper at time t2. After the change of the air flow rate, at time t3, the registration motor 19 starts to be driven, and a thick third sheet for the first copy is fed from the registration rollers 18 to the belt transfer unit 21. Then, after time t4 when the trailing edge of the thick sheet for the first copy passes the paper discharge sensor 43, the air flow rate of the fan 37 is changed from "high" to "low" at time t5. After the change of the air flow rate, at time t6, the registration motor 19 starts to be driven, and a thin first sheet for a second copy is fed from the registration rollers 18 to the belt transfer unit 21. After that, similar control is repeated.

As described above, in the example of FIG. 5(*a*), when the air flow rate of the fan 37 is changed between successive sheets, the air flow rate is changed after the precedent sheet is discharged, and then the subsequent sheet is fed.

On the other hand, in FIG. 5(*b*), when the trailing edge of a thin second sheet for a first copy reaches the paper sensor 24 at time t11, the air flow rate of the fan 37 is changed from "low" to "high" at time t12 immediately after time t11. After the change of the air flow rate, the registration motor 19 starts to be driven at time t13, and a thick sheet for the first copy is fed from the registration rollers 18 to the belt transfer unit 21. Then, immediately after the trailing edge of the thick sheet for the first copy reaches the paper sensor 24 at time t14, the air flow rate of the fan 37 is changed from "high" to "low" at time t15 immediately after time t14. After the change of the air flow rate, the registration motor 19 starts to be driven at time t16, and a thin first sheet for a second copy is fed from the registration rollers 18 to the belt transfer unit 21. After that, similar control is repeated.

As described above, in FIG. 5(*b*), when the air flow rate of the fan 37 is changed between successive sheets, the air flow rate is changed immediately after the trailing edge of the precedent sheet leaves the belt transfer unit 21, before the precedent sheet is discharged, and then the subsequent sheet is fed.

Accordingly, in FIG. 5(*b*), printing time is shortened, and productivity is improved, compared to those in FIG. 5(*a*).

Specifically, for each change of the air flow rate, printing time can be shortened by time T required to transfer a sheet of paper P from the paper sensor 24 to the paper discharge sensor 43. In other words, the length of time from the start of printing to time t17 when the trailing edge of the thick sheet for the first copy passes the paper discharge sensor 43 in FIG. 5(*b*) is shorter by T than the length of time from the start of printing to time t4 when the trailing edge of the thick sheet for the first copy passes the paper discharge sensor 43 in FIG. 5(*a*). Moreover, the length of time from the start of printing to time t18 when the trailing edge of the thick sheet for the second copy passes the paper discharge sensor 43 in FIG. 5(*b*) is shorter by 3 T than the length of time from the start of printing to time t7 when the trailing edge of the thick sheet for the second copy passes the paper discharge sensor 43 in FIG. 5(*a*).

Here, it is assumed that the length of time in the change of the air flow rate in FIG. 5(*a*) from the time when the trailing edge of a precedent sheet passes the paper discharge sensor 43 to the time when the air flow rate is changed and the length of time in the change of the air flow rate in FIG. 5(*b*) from the time when the trailing edge of a precedent sheet passes the paper sensor 24 to the time when the air flow rate is changed are the same. In other words, it is assumed that the lengths of time between times t1 and t2 and between times t4 and t5 in FIG. 5(*a*) are the same as the lengths of time between times t11 and t12 and between times t14 and t15 in FIG. 5(*b*), respectively. Moreover, it is assumed that the length of time from the time when the air flow rate is changed to the time when the registration motor 19 starts to be driven for the feed of a subsequent sheet is the same between FIGS. 5(*a*) and 5(*b*). In other words, it is assumed that the lengths of time between times t2 and t3 and between times t5 and t6 in FIG. 5(*a*) are the same as the lengths of time between times t12 and t13 and between times t15 and t16 in FIG. 5(*b*), respectively.

As described above, in the printing machine 1, in the case where the air flow rate of the fan 37 is changed between successive sheets, the change of the air flow rate and the feed of the subsequent sheet are performed before the precedent sheet is discharged. Thus, the printing machine 1 can reduce a decrease in productivity.

It should be noted that, though in the example of FIG. 5(*b*) the air flow rate is changed after the trailing edge of the precedent sheet reaches the paper sensor 24, the air flow rate may be changed at the time when the trailing edge of the precedent sheet reaches the paper sensor 24. This makes it possible to further shorten the distance between the precedent sheet and the subsequent sheet. As a result, a decrease in productivity can be further reduced.

Moreover, though in the example of FIG. 5(*b*) the registration motor 19 starts to be driven after the air flow rate is changed, the timing of paper feed may be controlled such that the leading edge of the subsequent sheet may enter the belt transfer unit 21 (reach the upstream end of the belt transfer unit 21) at the time when the air flow rate is changed.

In the above description of the control of the air flow rate of the fan 37 in a printing operation, the case of single-sided printing has been described. However, even in the case of double-sided printing, the control of the air flow rate similar to that for the case of single-sided printing can be performed.

For example, in the case where plural copies of a document including two thin sheets and one thick sheet as in FIGS. 5(*a*) and 5(*b*) are printed on both sides of each sheet, the controller 7 changes the air flow rate of the fan 37 from "low" to "high" after printing is performed on the back side of a thin second sheet for a certain copy and immediately after the trailing edge of the thin second sheet passes the downstream end of the belt transfer unit 21, and causes a thick sheet to be fed. Moreover, after printing is performed on the back side of the thick sheet and immediately after the trailing edge of the thick sheet passes the downstream end of the belt transfer unit 21, the controller 7 changes the air flow rate of the fan 37 from "high" to "low," and causes a thin first sheet for a subsequent copy to be fed.

Second Embodiment

A printing machine according to a second embodiment has the same configuration as the printing machine 1 of the first embodiment except for the control of the air flow rate of the fan 37 between successive sheets. Accordingly, in the second embodiment, FIGS. 1 and 2 are also used.

In the second embodiment, in the case where the air flow rate of the fan 37 is changed between successive sheets, the controller 7 controls the timing of change of the air flow rate in accordance with the combination (paper type combination) of the precedent sheet and the subsequent sheet in paper type and paper size.

Specifically, if the paper type combination of the precedent sheet and the subsequent sheet is a prescribed combination, the controller 7 changes the air flow rate of the fan 37 in a period after the leading edge of the precedent sheet reaches the downstream end of the belt transfer unit 21 and before the trailing edge of the precedent sheet reaches the downstream end of the belt transfer unit 21. If the paper type combination is other than the prescribed combination, the controller 7 changes the air flow rate of the fan 37 immediately after the trailing edge of the precedent sheet reaches the downstream end of the belt transfer unit 21.

FIG. 6 shows one example of the relationship between the paper type combination of a precedent sheet and a subsequent sheet and the timing for changing the air flow rate of the fan 37.

The paper type combination shown in a top row of FIG. 6 is referred to as a first combination. The first combination is the combination of a thick or ordinary precedent sheet of any size and a thin subsequent sheet of any size. The paper type combination shown in a middle row of FIG. 6 is referred to as a second combination. The second combination is the combination of a thin precedent sheet of a large size and a thick or ordinary subsequent sheet of any size. The paper type combination shown in a bottom row of FIG. 6 is referred to as a third combination. The third combination is the combination of a thin precedent sheet of a small size and a thick or ordinary subsequent sheet of any size. Here, for example, a small size means a size equal to or smaller than B5 size, and a large size means a size larger than B5 size.

In the case of the first combination, as shown in the top row of FIG. 6, the timing for changing the air flow rate is the time when the amount of transfer reaches a reference value after the leading edge of a precedent sheet reaches the downstream end of the belt transfer unit 21. As the reference value, a value set according to the paper size of the precedent sheet is used. Moreover, the reference value is a value smaller than the length of the precedent sheet in the transfer direction. In other words, in the case of the first combination, the air flow rate is changed in a period after the leading edge of the precedent sheet reaches the downstream end of the belt transfer unit 21 and before the trailing edge of the precedent sheet reaches the downstream end of the belt transfer unit 21.

For the first combination, the air flow rate of the fan 37 is changed from "high" to "low." Since the precedent sheet is a thick or ordinary sheet, the risk of a problem such as the occurrence of wrinkles in the precedent sheet is low even when the air flow rate is changed to "low" with part of the precedent sheet remaining on the transfer surface 31*a*. Accordingly, in the case of the first combination, the air flow rate is changed before the trailing edge of the precedent sheet reaches the downstream end of the belt transfer unit 21.

The reference value for the first combination is experimentally found in advance such that the sticking force of the precedent sheet to the transfer surface 31*a* can be maintained at a level large enough to prevent the sheet from being disturbed, even at the "low" air flow rate, from the time when the amount of transfer reaches the reference value after the leading edge of the precedent sheet reaches the downstream end of the belt transfer unit 21, to the time when the trailing edge of the precedent sheet passes the downstream end of the belt transfer unit 21.

In the case of the second combination, as shown in the middle row of FIG. 6, the timing for changing the air flow rate is the time when the trailing edge of the precedent sheet reaches the downstream end of the belt transfer unit 21.

For the second combination, the air flow rate of the fan 37 is changed from "low" to "high." Since the precedent sheet is a thin sheet of a large size, there is a risk of the occurrence of wrinkles in the precedent sheet when the air flow rate is changed to "high" with only a part of the precedent sheet remaining on the transfer surface 31*a*. Accordingly, in the case of the second combination, the air flow rate is changed at the time when the trailing edge of the precedent sheet reaches the downstream end of the belt transfer unit 21, i.e., at the time when the trailing edge of the precedent sheet leaves the belt transfer unit 21.

In the case of the third combination, as shown in the bottom row of FIG. 6, the timing for changing the air flow rate is the time when the amount of transfer reaches a reference value after the leading edge of the precedent sheet reaches the downstream end of the belt transfer unit 21. As similar to the reference value for the first combination, a value set according to the paper size of the precedent sheet is used as the reference value for the third combination. Moreover, the reference value for the third combination is a value smaller than the length of the precedent sheet with respect to the transfer direction. In other words, in the case of the third combination, the air flow rate is changed in a period after the leading edge of the precedent sheet reaches the downstream end of the belt transfer unit 21 and before the trailing edge of the precedent sheet reaches the downstream end of the belt transfer unit 21. Here, the reference value for the third combination is a value set separately from the reference value for the first combination.

For the third combination, the air flow rate of the fan 37 is changed from "low" to "high." The precedent sheet is a thin sheet but of a small size. Thus, the risk of a problem such as the occurrence of wrinkles in the precedent sheet is low even when the air flow rate is changed to "low" with part of the precedent sheet remaining on the transfer surface 31*a*. Accordingly, in the case of the third combination, the air flow rate is changed before the trailing edge of the precedent sheet reaches the downstream end of the belt transfer unit 21.

The reference value for the third combination is experimentally found in advance such that no wrinkles may occur in the precedent sheet partly remaining on the transfer surface 31*a*, even when the air flow rate is changed to "high" at the time when the amount of transfer reaches the reference value after the leading edge of the precedent sheet reaches the downstream end of the belt transfer unit 21. Here, even a thin sheet of a small size may have wrinkles if a portion of the sheet which remains on the transfer surface 31*a* when the air flow rate is changed to "high" has a too large area. Accordingly, the reference value for the third combination is set such that a portion of the precedent sheet which remains on the transfer surface 31*a* when the air flow rate is changed to "high" may have an area not allowing wrinkles to occur.

Next, the control of the air flow rate of the fan 37 in a printing operation according to the second embodiment will be described with reference to a flowchart of FIG. 7. Here, the case of single-sided printing will be described.

Figure 7:
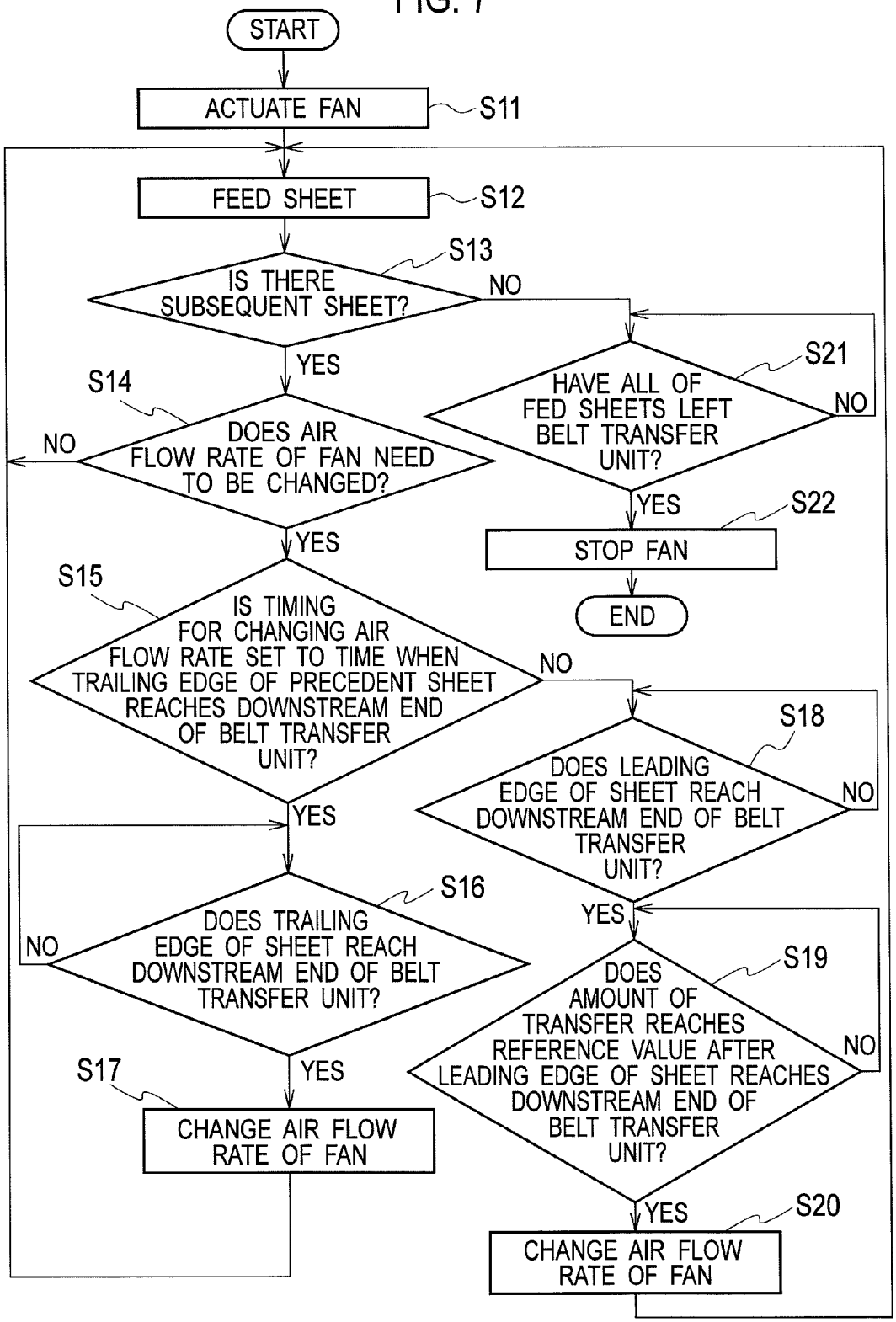
FIG. 7 is a flowchart showing the control of the air flow rate of the fan according to the second embodiment.

A process shown in the flowchart of FIG. 7 is started by submitting a print job to the controller 7. Processing of steps S11 to S14 in FIG. 7 is similar to the aforementioned processing of steps S1 to S4 in FIG. 4.

If the controller 7 determines in step S14 that the air flow rate of the fan 37 does not need to be changed (step S14: NO), the controller 7 determines in step S15 whether or not the timing for changing the air flow rate is the time when the trailing edge of the precedent sheet reaches the downstream end of the belt transfer unit 21. Here, the controller 7 determines based on the paper type combination of the most recently fed sheet P and a subsequent sheet P whether or not the timing for changing the air flow rate is the time when the trailing edge of the precedent sheet reaches the downstream end of the belt transfer unit 21. Specifically, in the case of the second combination in FIG. 6, the controller 7 determines that the timing for changing the air flow rate is the time when the trailing edge of the precedent sheet reaches the downstream end of the belt transfer unit 21. On the other hand, in the case of the first or third combination in FIG. 6, the controller 7 determines that the timing for changing the air flow rate is not the time when the trailing edge of the precedent sheet reaches the downstream end of the belt transfer unit 21.

If the controller 7 determines that the timing for changing the air flow rate is the time when the trailing edge of the precedent sheet reaches the downstream end of the belt transfer unit 21 (step S15: YES), the controller 7 goes to step S16. On the other hand, if the controller 7 determines that the timing for changing the air flow rate is not the time when the trailing edge of the precedent sheet reaches the downstream end of the belt transfer unit 21 (step S15: NO), the controller 7 goes to step S18.

Processing of step S16 is similar to the aforementioned processing of step S5 in FIG. 4. If the controller 7 determines in step S16 that the trailing edge of the most recently fed sheet P reaches the downstream end of the belt transfer unit 21 (step S16: YES), the controller 7 immediately changes the air flow rate of the fan 37 to the air flow rate corresponding to the subsequent sheet P in step S17.

Then, the controller 7 causes the subsequent sheet P to be fed from the registration rollers 18 to the transfer and print unit 3 in step S12. Here, the controller 7 controls the timing of paper feed so that the leading edge of the subsequent sheet P may enter the belt transfer unit 21 (reach the upstream end of the belt transfer unit 21) at the time when the air flow rate is changed.

In step S18, the controller 7 determines whether or not the leading edge of the most recently fed sheet P reaches the downstream end of the belt transfer unit 21. Specifically, the controller 7 determines whether or not the paper sensor 24 has detected the leading edge of the most recently fed sheet P. It should be noted that the controller 7 may determine, based on the number of pulses outputted from the encoder 22 after the leading edge of the most recently fed sheet P reaches the upstream end of the belt transfer unit 21, whether or not the leading edge of the most recently fed sheet P reaches the downstream end of the belt transfer unit 21.

If the controller 7 determines that the leading edge of the most recently fed sheet P does not reach the downstream end of the belt transfer unit 21 (step S18: NO), the controller 7 repeats step S18.

If the controller 7 determines that the leading edge of the most recently fed sheet P reaches the downstream end of the belt transfer unit 21 (step S18: YES), the controller 7 determines in step S19 whether or not the amount of transfer reaches the aforementioned reference value after the leading edge of the sheet P reaches the downstream end of the belt transfer unit 21. Specifically, the controller 7 determines whether or not the number of pulses outputted from the encoder 22 after the leading edge of the sheet P reaches the downstream end of the belt transfer unit 21 reaches a value corresponding to the reference value for the amount of transfer. As the reference value, the reference value corresponding to any of the combinations is used, depending on whether the paper type combination of the most recently fed sheet P and the subsequent sheet P is the first or third combination.

If the controller 7 determines that the reference value is not reached yet (step S19: NO), the controller 7 repeats step S19.

If the controller 7 determines that the reference value is reached (step S19: YES), the controller 7 immediately changes the air flow rate of the fan 37 to the air flow rate corresponding to the subsequent sheet P in step S20.

Then, the controller 7 causes the subsequent sheet P to be fed from the registration rollers 18 to the transfer and print unit 3 in step S12. Here, the controller 7 controls the timing of paper feed so that the leading edge of the subsequent sheet P may enter the belt transfer unit 21 (reach the upstream end of the belt transfer unit 21) at the time when the air flow rate is changed.

If the controller 7 determines in step S13 that there is no subsequent sheet P (step S13: NO), the controller 7 goes to step S21. Processing of steps S21 and S22 is similar to the aforementioned processing of steps S6 and S7 in FIG. 4. Thus, the control of the air flow rate of the fan 37 is ended.

Figure 8:
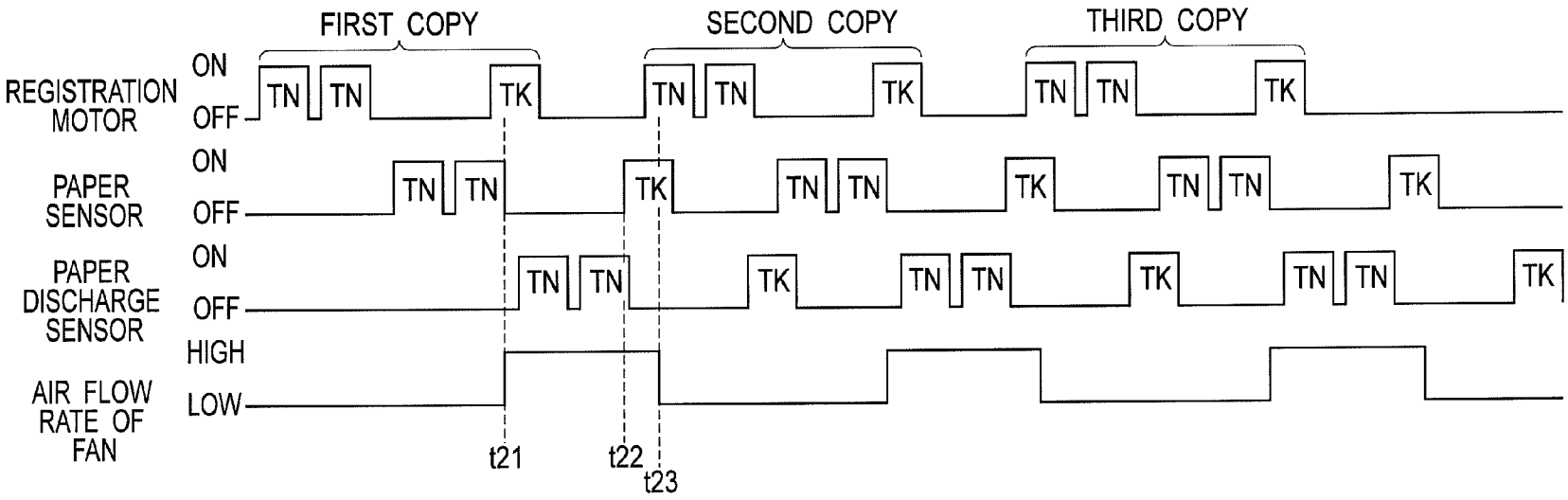
FIG. 8 is a timing diagram for an example of the control of the air flow rate of the fan according to the second embodiment.

Next, an example of the control of the air flow rate according to the above-described process shown in the flowchart of FIG. 7 will be described with reference to a timing diagram of FIG. 8. FIG. 8 shows the control of the air flow rate for the case where plural copies of a document including two thin sheets and one thick sheet of a large size are printed on one side of each sheet.

In FIG. 8, when the trailing edge of a thin second sheet for a first copy reaches the paper sensor 24 at time t21, the air flow rate of the fan 37 is changed from "low" to "high" at that time t21. This is the change of the air flow rate with the timing for the aforementioned second combination in FIG. 6. Moreover, the driving of the registration motor 19 for transferring the thick third sheet is started before time t21 so that the leading edge of a thick sheet as a third sheet for a first copy may reach the upstream end of the belt transfer unit 21 at time t21.

After the change of the air flow rate, when the leading edge of the thick third sheet reaches the paper sensor 24 at time t22, the air flow rate of the fan 37 is changed from "high" to "low" at time t23 when the amount of transfer after that time t22 reaches the reference value. This is the change of the air flow rate with the timing for the aforementioned first combination in FIG. 6. Moreover, the driving of the registration motor 19 for transferring the thin first sheet for the second copy is started before time t23 so that the leading edge of a thin first sheet for a second copy may reach the upstream end of the belt transfer unit 21 at time t23. After that, similar control is repeated.

Figure 9:
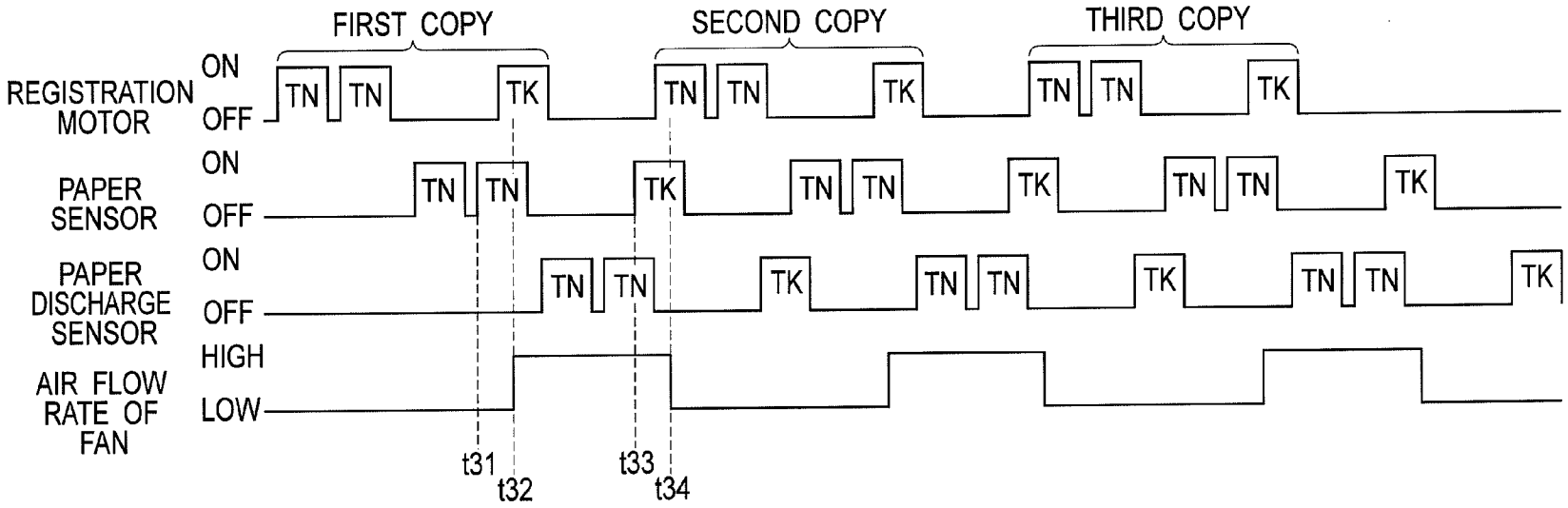
FIG. 9 is a timing diagram for another example of the control of the air flow rate of the fan according to the second embodiment.

Next, another example of the control of the air flow rate according to the above-described process shown in the flowchart of FIG. 7 will be described with reference to a timing diagram of FIG. 9. FIG. 9 shows the control of the air flow rate for the case where plural copies of a document including two thin sheets and one thick sheet of a small size are printed on one side of each sheet.

In FIG. 9, when the leading edge of a thin second sheet for a first copy reaches the paper sensor 24 at time t31, the air flow rate of the fan 37 is changed from "low" to "high" at time t32 when the amount of transfer after that time t31 reaches the reference value. This is the change of the air flow rate with the timing for the aforementioned third combination in FIG. 6. Moreover, the driving of the registration motor 19 for transferring a thick third sheet for the first copy is started before time t32 so that the leading edge of the thick third sheet may reach the upstream end of the belt transfer unit 21 at time t32.

After the change of the air flow rate, when the leading edge of the thick third sheet reaches the paper sensor 24 at time t33, the air flow rate of the fan 37 is changed from "high" to "low" at time t34 when the amount of transfer after that time t33 reaches the reference value. This is the change of the air flow rate with the timing for the aforementioned first combination in FIG. 6. Moreover, the driving of the registration motor 19 for transferring a thin first sheet for a second copy is started before time t34 so that the leading edge of the thin first sheet for the second copy may reach the upstream end of the belt transfer unit 21 at time t34. After that, similar control is repeated.

As described above, in the second embodiment, in the case where the paper type combination between a precedent sheet and a subsequent sheet is a prescribed combination, the controller 7 changes the air flow rate of the fan 37 in a period after the leading edge of the precedent sheet reaches the downstream end of the belt transfer unit 21 and before the trailing edge of the precedent sheet reaches the downstream end of the belt transfer unit 21. This makes it possible to shorten the distance between the precedent sheet and the subsequent sheet while reducing sheet deterioration such as the occurrence of wrinkles. As a result, it becomes possible to further reducing a decrease in productivity while reducing sheet deterioration.

It should be noted that in the second embodiment, also, in the above description of the control of the air flow rate of the fan 37 in a printing operation, the case of single-sided printing has been described. However, as in the first embodiment, the control of the air flow rate similar to that for the case of single-sided printing can also performed in the case of double-sided printing.

Other Embodiments

As described above, the present invention has been described based on the first and second embodiments. However, the descriptions and drawings constituting part of the present disclosure should not be construed as limiting the present invention. From the present disclosure, various alternative embodiments, examples, and practical techniques will be apparent to those skilled in the art.

In the above-described first and second embodiments, the printing machine 1 including the belt transfer unit 21 of an air suction type has been described. However, a configuration in which paper is transferred by another method may be employed. For example, a type in which paper is electrostatically attached to a charging belt to be transferred may be employed.

Embodiments of the present invention have been described above. However, the invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and range of equivalency of the claims are therefore intended to be embraced therein.

Moreover, the effects described in the embodiments of the present invention are only a list of optimum effects achieved by the present invention. Hence, the effects of the present invention are not limited to those described in the embodiment of the present invention.

What is claimed is:

1. A printing machine comprising:

a paper feed unit configured to feed a sheet of paper;

a suction transfer unit configured to transfer the sheet of paper fed by the paper feed unit in a transfer direction, with the sheet of paper being attached by suction onto a transfer surface;

a transfer and paper discharge unit configured to receive the sheet of paper from the suction transfer unit to transfer and discharge the sheet of paper; and a controller configured to control a suction force of the suction transfer unit in accordance with a paper type, wherein when the controller changes the suction force of the suction transfer unit between successive sheets of paper, the controller is configured prior to a discharge of a precedent sheet of paper to change the suction force of the suction transfer unit and drive the paper feed unit to feed a subsequent sheet of paper, wherein when the controller changes the suction force of the suction transfer unit between the successive sheets of paper, and when the precedent sheet of paper and the subsequent sheet of paper are in a prescribed combination in the paper type and a paper size, the controller is configured to change the suction force of the suction transfer unit in a period after a leading edge of the precedent sheet of paper reaches the downstream end of the suction transfer unit in the transfer direction and before a trailing edge of the precedent sheet of paper reaches a downstream end of the suction transfer unit.

2. The printing machine according to claim 1, wherein when the controller changes the suction force of the suction transfer unit between the successive sheets of paper, the controller is configured to change the suction force of the suction transfer unit at a time when a trailing edge of the precedent sheet of paper reaches a downstream end of the suction transfer unit in the transfer direction.

* * * * *